US007082991B2

(12) United States Patent
Sommers et al.

(10) Patent No.: US 7,082,991 B2
(45) Date of Patent: Aug. 1, 2006

(54) SLIP SPRING WITH HEEL NOTCH

(75) Inventors: Michael T. Sommers, Beggs, OK (US); Robert L. Brookey, Tulsa, OK (US)

(73) Assignee: Team Oil Tools, Tulsa, OK (US)

( * ) Notice: Subject to any disclaimer, the term of this patent is extended or adjusted under 35 U.S.C. 154(b) by 98 days.

(21) Appl. No.: 10/418,120

(22) Filed: Apr. 18, 2003

(65) Prior Publication Data

US 2003/0196794 A1 Oct. 23, 2003

Related U.S. Application Data

(60) Provisional application No. 60/373,309, filed on Apr. 18, 2002, provisional application No. 60/373,308, filed on Apr. 18, 2002.

(51) Int. Cl.
*E21B 23/01* (2006.01)
*E21B 19/10* (2006.01)

(52) U.S. Cl. ..... 166/134; 166/214; 175/423

(58) Field of Classification Search ..... 166/136, 166/137, 214–217, 134
See application file for complete search history.

(56) References Cited

U.S. PATENT DOCUMENTS

| | | | | | |
|---|---|---|---|---|---|
| 2,568,005 | A | * | 9/1951 | Holder et al. | 166/215 |
| 3,270,819 | A | * | 9/1966 | Thrane et al. | 166/124 |
| 3,291,220 | A | * | 12/1966 | Mott | 166/208 |
| 3,456,723 | A | * | 7/1969 | Current et al. | 166/120 |
| 3,570,596 | A | * | 3/1971 | Young | 166/129 |
| 4,284,137 | A | * | 8/1981 | Taylor | 166/137 |
| 4,345,646 | A | * | 8/1982 | Terrell | 166/55 |
| 4,530,398 | A | * | 7/1985 | Greenlee et al. | 166/123 |
| 4,662,453 | A | * | 5/1987 | Brisco | 166/387 |
| 4,921,045 | A | * | 5/1990 | Richardson | 166/134 |
| 5,423,382 | A | * | 6/1995 | Barton et al. | 166/297 |
| 5,771,970 | A | * | 6/1998 | Jani | 166/216 |

* cited by examiner

*Primary Examiner*—David Bagnell
*Assistant Examiner*—Shane Bomar
(74) *Attorney, Agent, or Firm*—Merek, Blackmon & Voorhees, LLC

(57) ABSTRACT

In order to prevent premature separation of the slip and slip spring and to simplify production of the slip casing, a self-centering spring engageable with a packer tool slip is modified according to the present invention. A groove located at a lower center of the slip below the pocket of the slip cooperates with the spring to retain the spring against the slip and is centered within the pocket without requiring partitions or further welding of lugs to retain the springs.

5 Claims, 5 Drawing Sheets

SLIP SPRING WITH HEEL NOTCH

CROSS REFERENCE TO RELATED APPLICATIONS

This application claims the benefit and is related to Application Ser. No. 60/373,309 filed Apr. 18, 2002, entitled *Patriot Retrievable Production Packer* which is hereby incorporated by reference.

This application claims priority to Provisional Application 60/373,308 filed Apr. 18, 2002, and this provisional application is hereby incorporated by reference.

BACKGROUND OF THE INVENTION

A. Field of the Invention

The present invention relates to a new arrangement for a slip spring for downhole tools such as packer tools, retrievable bridge plugs or the like.

B. Description of the Prior Art

In order to insert, set and retrieve packer tools and similar devices, complex arrangements of shear pins, springs, J tools, slips and drag blocks have been developed so that the packer tools or other devices can be reused. The drag blocks and slips must be able to selectively engage the inner wall of the well bore so that the tool can be set or unset, often by rotating the tool to either shear a pin, engage or disengage a J tool or by compressing or expanding the tool to lock or unlock. This is well known as shown for example in U.S. Pat. No. 5,197,547 to Morgan. The slips 62 in the Morgan patent are activated as the annular tapered surface 61 slides ("wedges") behind the slips 62 forcing them outwardly until engage the well bore.

Prior to the current invention, complex casings were developed to retain the springs and slips in place during installation and run in. As shown in FIGS. 1 and 2, casing 210 has a number of partitions 212 machined or welded into the casing. Slots 214 provide a registration point for the slips 216 and allow the base of the slips to rotate free of the casing wall. The upper portion protrudes from above the casing and are held within the outer diameter of the casing wall by a retaining spring 218 (FIG. 2A) which urges the slip inwardly from the casing wall. The partition 212 is necessary to hold the spring 218 inside the pocket 220 provided along the length of the slip 216 since the pocket 220 has no sides to retain the spring. It is also usually necessary to weld or machine lugs along the inner portion of the partitions to further locate and center the springs securely within the slip.

The current invention provides a self-centering spring engageable with a slip modified according to the present invention. A groove located at a lower center of the slip below the pocket of the slip cooperates with the spring to retain the spring against the slip and centered within the pocket without requiring the partitions or further welding of lugs to retain the springs.

None of the above inventions and patents, taken either singly or in combination, is seen to describe the instant invention as claimed.

SUMMARY OF THE INVENTION

Accordingly, it is a principal object of the invention to provide a slip spring with a centering or retaining tab for positioning the slip spring relative to a slip.

It is another object of the invention to provide a combination of slip and centered slip spring which can be used in a packer tool with out requiring lugs to position the slip and or slip spring.

It is a further object of the invention to provide a cooperating slip spring tab and slip groove to center a slip spring in the pocket of a slip.

Still another object of the invention is to provide a method of centering a slip spring on a slip by providing a slip spring with a center tab which mates with a groove provided adjacent the pocket of a slip to center the slip spring on the slip independent of interaction of the slip spring with the casing.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention relates to an improvement in the construction and location of slips and springs inside a casing.

Figure 1:
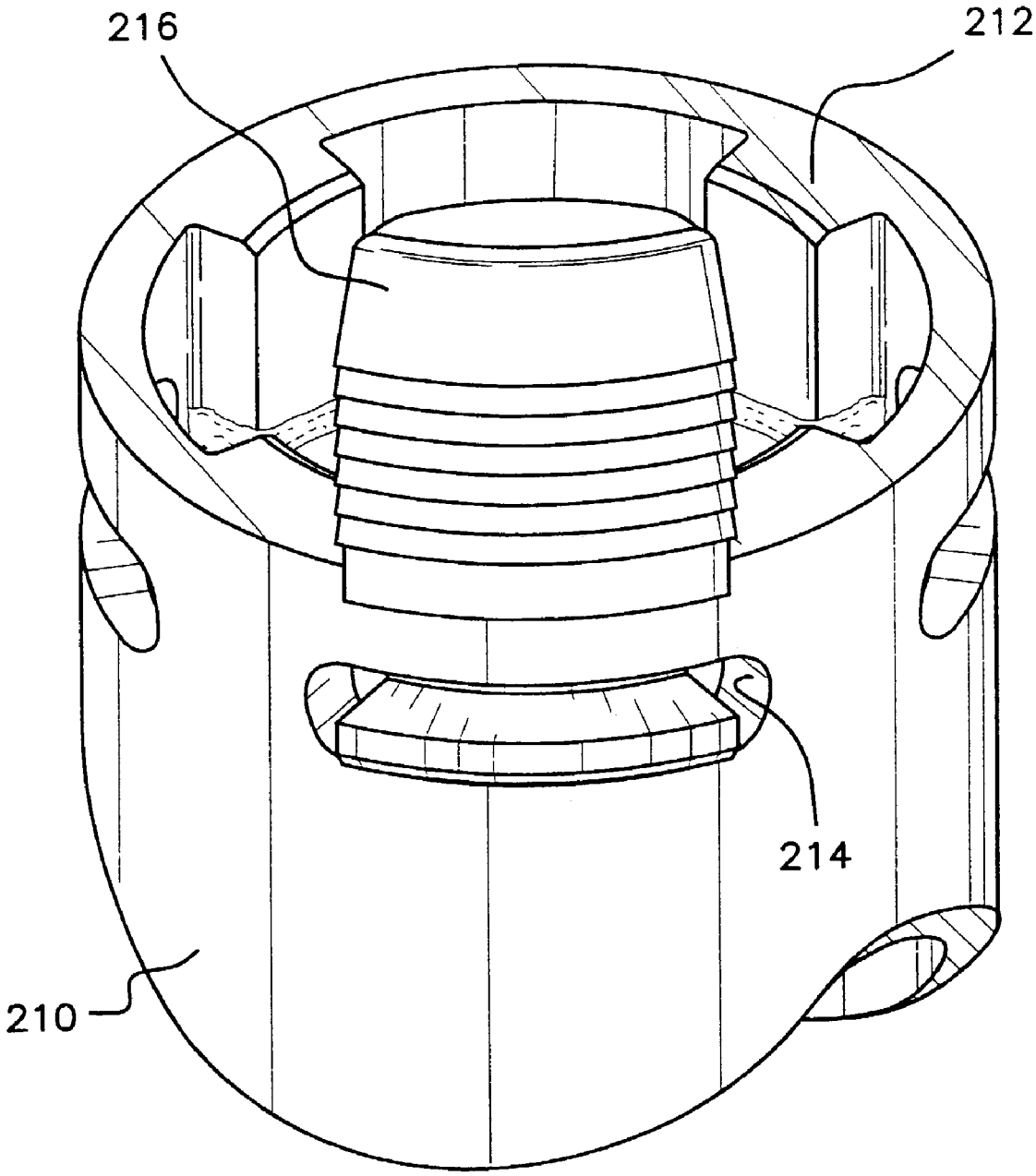
FIG. 1 (PRIOR ART)
FIG. 1 is an environmental perspective of a prior art slip installed in a packer tool casing.
Figure 2A:
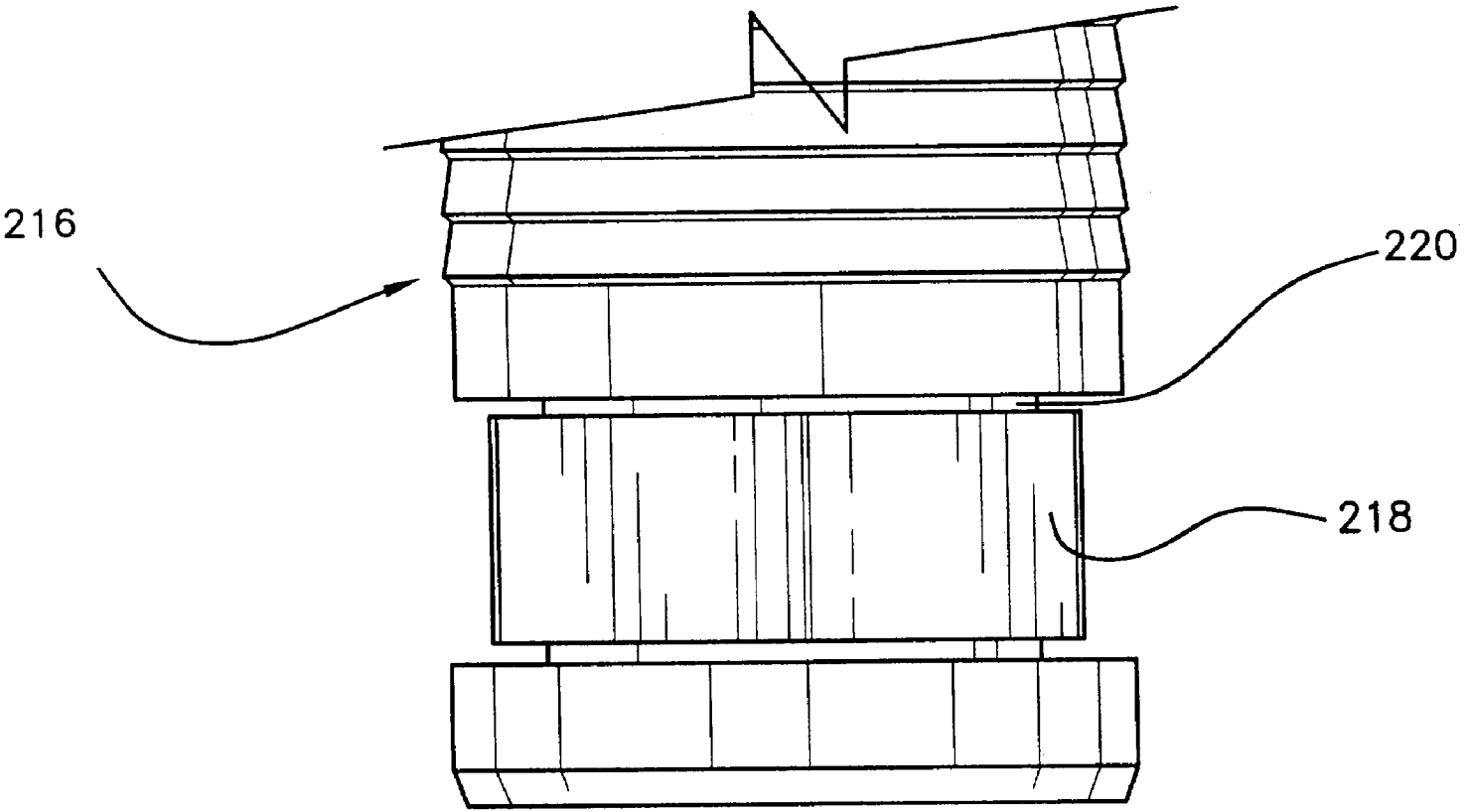
FIG. 2A (PRIOR ART)
FIG. 2A is a front plan view of a prior art slip and slip spring.
Figure 2B:
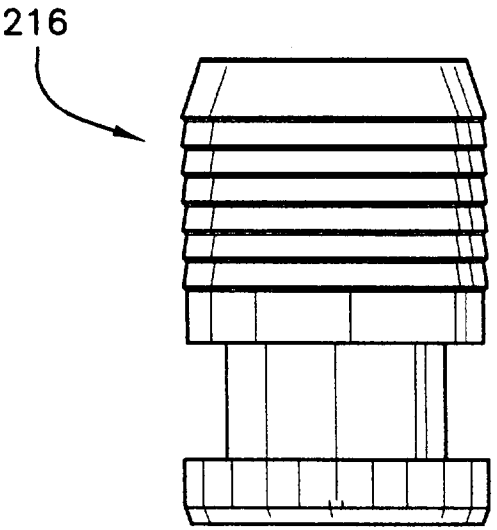
FIG. 2B (PRIOR ART)
FIG. 2B is a front plan view of a prior art slip.

FIGS. 1 and 2 show prior art casings for retaining a slip and slip spring. The casing 210 has a number of partitions 212 locate around its periphery. A like number of openings 214 are provided between adjacent partitions for receiving a lower end of a slip 216. The slips 216 are shown in FIGS. 2A and B have a pocket 220 for receiving a prior art spring ("tabless spring") 218. When the slip 216 with spring 218 located in its pocket is inserted into the casing 210 the spring is trapped between the slip and casing. The top and bottom of the spring are bounded by the walls of the pocket 218 of the slip 216. The free ends of the spring 218 which are not bounded by the slip 216 are bounded by the walls of the partitions 212. If the walls are insufficient to bound the springs, then extension lugs can be welded to an interior wall of the partition to center the spring about the slip. Disengagement of the springs will prevent the slips from withdrawing fully from the walls of the well bore during removal or repositioning of the packer tool (not shown) complicating removal of the packer tool from the well bore.

Because the springs are curved in the prior art arrangement, the ends of the springs necessarily point towards the gap where the outer edge of the partition 212 meets the edge of the pocket 220 on the slip 216. Therefore it is possible for the spring to "escape" by sliding between the side wall of the partition and the back of the pocket 220 if the spring is allowed to rotate. Further welding (or machining) of lugs to prevent this escape are often required to further trap the spring into place.

Figure 3:
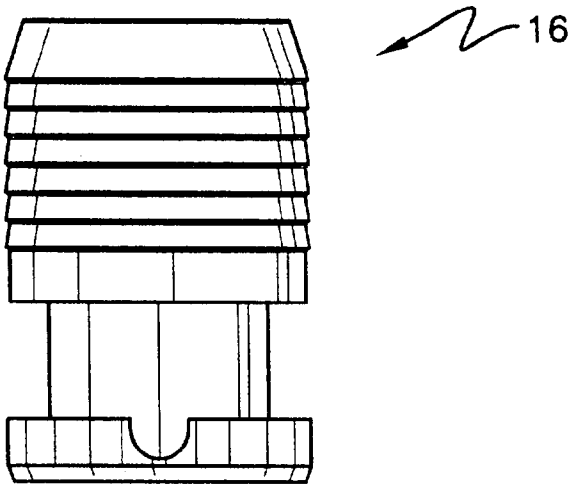
FIG. 3 is a front plan view of a slip according to the present invention having a tab receiving groove.
Figure 4:
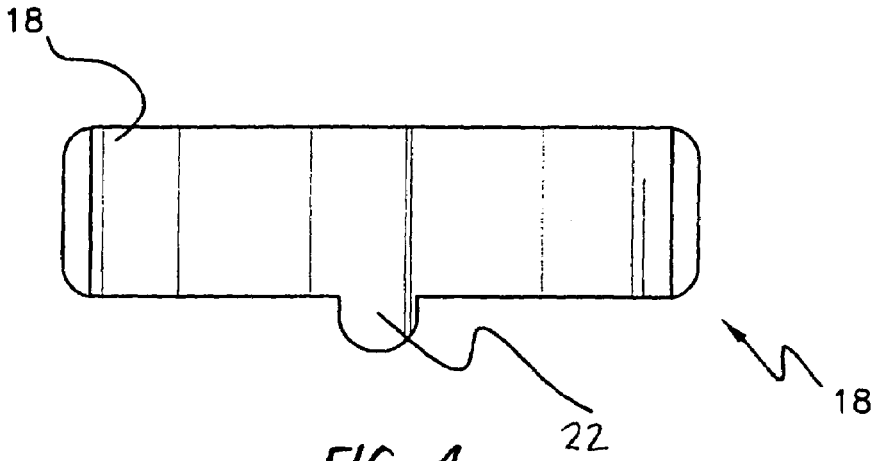
FIG. 4 shows a slip spring having a centering tab according to the present invention.
Figure 5:
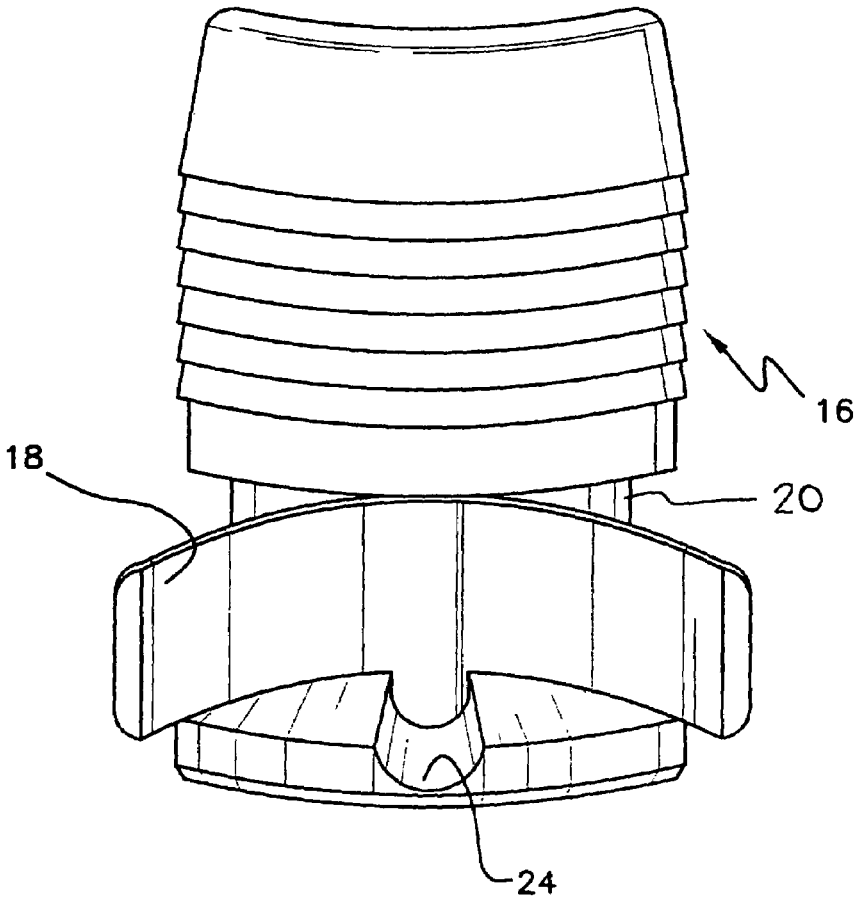
FIG. 5 shows a spring installed in the pocket of a slip according to the present invention.

In order to prevent premature separation of the slip and slip spring and to simplify production of the slip casing, the present invention teaches a modification of the slip and spring. As shows in FIGS. 3–5, the slip spring 18 has been modified according to the present invention to include a tab 22 centered about its length and protruding downwardly therefrom. The tab is shaped to mate with a groove 24 machined or otherwise formed into the slip preferably below in foot of the slip below the slip pocket 20. The exact shape of the tab and groove is not essential as long as the groove is shaped to closely receive the tab. Preferably the sides of the tab are rounded and smoothed so that the spring can engage the groove securely without catching and to simplify formation of the tab. The tab should likewise be sized such that the spring cannot disengage from the groove as the spring slides vertically within the pocket. The tab should also be sized sufficiently to withstand any torque or other forces placed on the tab as the slips are installed or move during operation.

Figure 6:
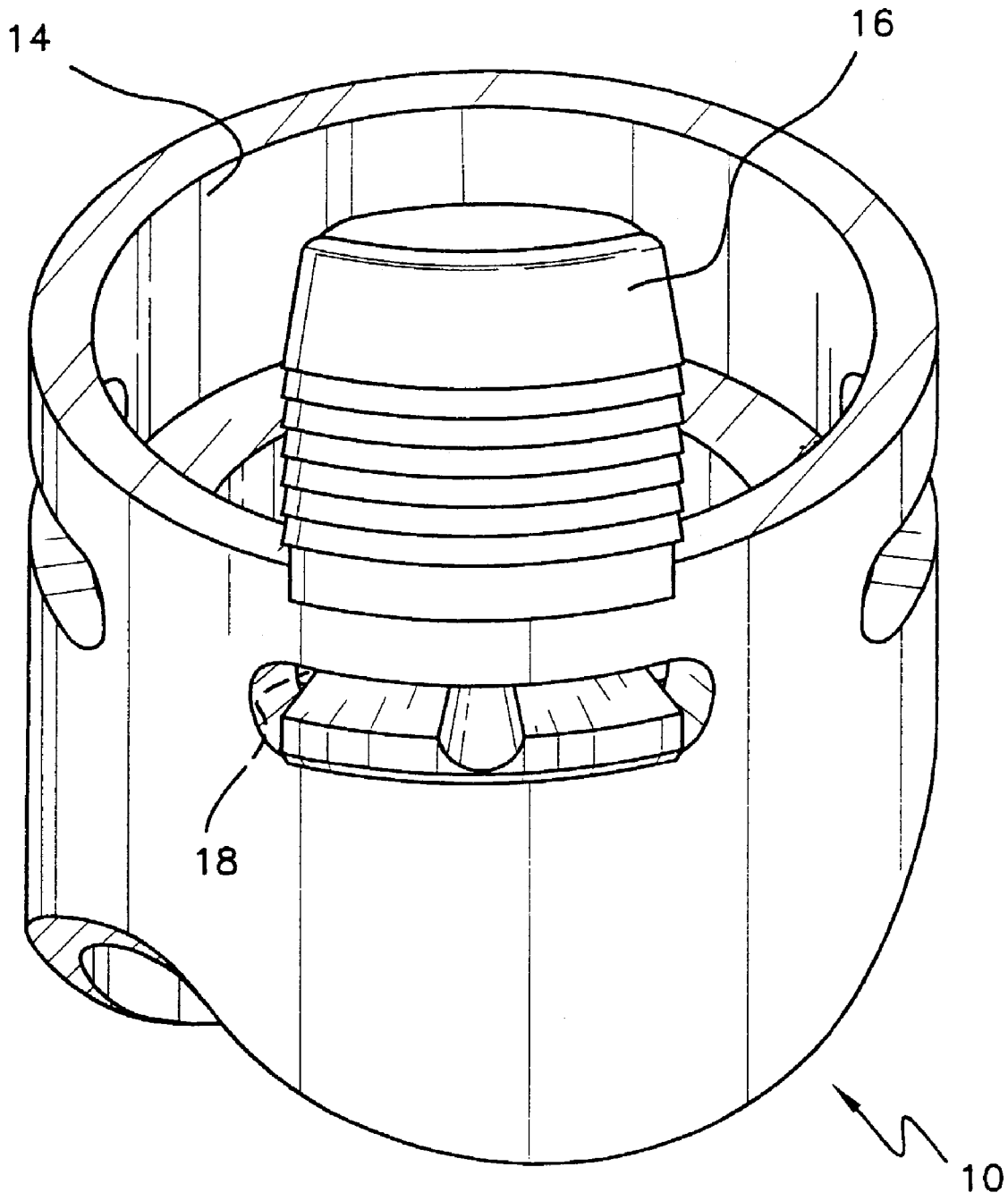
FIG. 6 shows a slip and slip spring installed in a lugless casing of a packer tool.

As shown in FIG. 6, when the slip 16 and spring 18 are installed into the casing 10, the spring 18 is trapped in the pocket 20 of the slip 16 between the slip and the inner casing wall. The slip 16 is located in the casing by positioning the lower end of the slip in the opening 14 of the casing. The spring 18 is thus centered about the slip about the tab 22 riding in the groove 24. The spring is prevented towards the slip or radially outwardly from the slip by the slip and the casing wall. The spring is prevented from moving vertically by the walls of the pocket 20. The spring is prevented from moving out of the pocket along the casing wall by the tab 22. Additionally the spring cannot rotate (i.e., one end moves closer to the slip as one end moves away from the slip) by the tab. Therefore the slip and spring act as a joined pair and the spring cannot prematurely disengage from the slip.

The inclusion of the tab and groove have the beneficial result of eliminating the need for the partitions significantly simplifying the machining of the casing as readily apparent from a review of the prior art casing in FIG. 1 and the casing of the current invention in FIG. 6. Welding or machining of lugs to hold the springs is also eliminated saving additional man hours and materials.

In operation, when the slips are urged outwardly by a wedge or other tapered surface, the springs will compress allowing the slips to move outwardly from the casing causing the slip teeth to move outwardly against a well bore or other surface surrounding the casing. When the slips. 16 are to be withdrawn into alignment with the casing and as a wedge or tapered surface is released from behind the slips, the spring urges the slip inwardly from the well bore as the spring pushes against the inner wall of the casing releasing the teeth of the slip.

It is to be understood that the present invention is not limited to the sole embodiment described above, but encompasses any and all embodiments within the scope of the following claims.

We claim:

1. A self-centering, spring retaining system comprising:

an elongated slip body having wall engaging teeth proximate a first end and a slip foot at a second end;

said slip body further including means defining a spring receiving groove in between said slip foot and said wall engaging teeth;

said slip body further including means defining a tab receiving slot within said slip body and adjacent said means defining a spring receiving groove, whereby said slot is connected to and in communication with said spring receiving groove;

a spring having an elongate body extending in a first direction along said spring receiving groove and dimensioned to be received within said spring receiving groove;

said spring further including a spring retaining tab projecting outwardly from a central portion of said elongate body, whereby when said spring elongate body is received within said spring receiving groove, said spring retaining tab is retained within said tab receiving slot to center said spring about said slip body and prevent rotational movement of said spring and to prevent said spring from sliding within said groove in said first direction.

2. A slip body for receiving a spring having an arcuate spring body and a spring retaining tab extending orthogonally from a central portion of the arcuate body, said slip body comprising:

an elongated slip body having wall engaging teeth proximate a first end and a slip foot for engaging a casing at a second end, and a middle portion between said wall engaging teeth and said slip foot;

said slip body having a first predetermined length from said first end to said second end along an axial direction, and a first predetermined width in said middle portion extending perpendicular to said axial direction, said slip body further including means defining a spring receiving groove extending said first width of said slip body in said middle section;

said slip body further including means defining a tab receiving slot adjacent said means defining a spring receiving groove, whereby said slot is connected to and in communication with said spring receiving groove;

whereby when the spring arcuate body is received within said spring receiving groove, the spring retaining tab is retained within said tab receiving slot to prevent rotational movement of said spring about said tab receiving slot and to prevent said spring from sliding within said groove in said first direction.

3. A slip body for receiving a spring having an arcuate spring body and a spring retaining tab extending outwardly from a central portion of the arcuate body, said slip body comprising:

an elongated slip body having wall engaging teeth proximate a first end and a slip foot for engaging a casing at a second end, and a middle portion between said wall engaging teeth and said slip foot;

said slip body having a first predetermined length from said first end to said second end along an axial direction, and a first predetermined width in said middle portion extending perpendicular to said axial direction;

said middle section including means defining a spring receiving channel extending along said first width of said slip body in said middle section;

said spring receiving channel having a first side wall proximate said wall engaging teeth and a second wall proximate said slip foot, and a third wall connecting said first wall and said second wall;

said slip body further including means defining a tab receiving slot adjacent said means defining a spring receiving groove, whereby said slot is connected to and in communication with said spring receiving groove;

wherein said tab receiving slot is a slot defined within one of said first wall, and said second wall;

whereby when the spring arcuate body is received within said spring receiving groove, the spring retaining tab is retained within said tab receiving slot to prevent rotational movement of said spring about said tab receiving slot and to prevent said spring from sliding within said groove in said first direction.

4. The slip body according to claim 3, wherein said tab receiving slot is a slot defined within said first wall.

5. The slip body according to claim 3, wherein said tab receiving slot is a slot defined within said second wall.

* * * * *